US005882364A

United States Patent [19]

Dilworth

[11] Patent Number: 5,882,364

[45] Date of Patent: Mar. 16, 1999

[54] ADDITIVES AND FUEL OIL COMPOSITIONS

[75] Inventor: Brid Dilworth, Oxfordshire, United Kingdom

[73] Assignee: Exxon Chemical Patents Inc., Linden, N.J.

[21] Appl. No.: 981,132

[22] PCT Filed: Jul. 11, 1996

[86] PCT No.: PCT/EP96/03105

§ 371 Date: Nov. 24, 1997

§ 102(e) Date: Nov. 24, 1997

[87] PCT Pub. No.: WO97/04044

PCT Pub. Date: Feb. 6, 1997

[30] Foreign Application Priority Data

Jul. 14, 1995 [GB] United Kingdom ..... 9514480

[51] Int. Cl.[6] ..... C10L 1/18

[52] U.S. Cl. ..... 44/400; 44/389

[58] Field of Search ..... 44/400, 389

[56] References Cited

U.S. PATENT DOCUMENTS

| | | | |
|---|---|---|---|
| 2,527,889 | 10/1950 | Moore et al. | 44/66 |
| 2,548,347 | 4/1951 | Caron et al. | 44/400 |
| 3,713,792 | 1/1973 | Wiley | 44/400 |
| 5,730,029 | 3/1998 | Stoldt et al. | 44/389 |

FOREIGN PATENT DOCUMENTS

| | | |
|---|---|---|
| 0227218 | 7/1987 | European Pat. Off. . |
| 9417160 | 8/1994 | WIPO . |

*Primary Examiner*—Jerry D. Johnson
*Attorney, Agent, or Firm*—Ohlandt, Greeley, Ruggiero & Perle

[57] ABSTRACT

Fuel oil compositions containing specific mixtures of esters of unsaturated monocarboxylic acids show improved lubricity properties.

21 Claims, No Drawings

ADDITIVES AND FUEL OIL COMPOSITIONS

This application is a Rule 371 of PCT/EP96/03105 file 11 Jul. 1996.

This invention relates to additives for improving the lubricity of fuel oils such as diesel fuel oil. Diesel fuel oil compositions including the additives exhibit improved lubricity and reduced engine wear.

Concern for the environment has resulted in moves to significantly reduce the noxious components in emissions when fuel oils are burnt, particularly in engines such as diesel engines. Attempts are being made, for example, to minimise sulphur dioxide emissions. As a consequence attempts are being made to minimise the sulphur content of fuel oils. For example, although typical diesel fuel oils have in the past contained 1% by weight or more of sulphur (expressed as elemental sulphur) it is now considered desirable to reduce the level, preferably to 0.05% by weight and, advantageously, to less than 0.01% by weight, particularly less than 0.001% by weight.

Additional refining of fuel oils, necessary to achieve these low sulphur levels, often results in reductions in the level of polar components. In addition, refinery processes can reduce the level of polynuclear aromatic compounds present in such fuel oils.

Reducing the level of one or more of the sulphur, polynuclear aromatic or polar components of diesel fuel oil can reduce the ability of the oil to lubricate the injection system of the engine so that, for example, the fuel injection pump of the engine fails relatively early in the life of an engine. Failure may occur in fuel injection systems such as high pressure rotary distributors, in-line pumps and injectors. The problem of poor lubricity in diesel fuel oils is likely to be exacerbated by the future engine developments aimed at further reducing emissions, which will have more exacting lubricity requirements than present engines. For example, the advent of high pressure unit injectors is anticipated to increase the fuel oil lubricity requirement.

Similarly, poor lubricity can lead to wear problems in other mechanical devices dependent for lubrication on the natural lubricity of fuel oil.

Lubricity additives for fuel oils have been described in the art. WO 94/17160 describes an additive which comprises an ester of a carboxylic acid and an alcohol wherein the acid has from 2 to 50 carbon atoms and the alcohol has one or more carbon atoms. Glycerol monooleate is specifically disclosed as an example. Although general mixtures are contemplated, no specific mixtures of esters are disclosed.

U.S. Pat. No. 3,273,981 discloses a lubricity additive being a mixture of A+B wherein A is a polybasic acid, or a polybasic acid ester made by reacting the acid with $C_1$–$C_5$ monohydric alcohols; while B is a partial ester of a polyhydric alcohol and a fatty acid, for example glyceryl monooleate, sorbitan monooleate or pentaerythitol monooleate. The mixture finds application in jet fuels.

However, in certain circumstances such prior art esters have unexpectedly been found to promote the blocking of fuel filters, particularly the fine-mesh filters typically present in diesel vehicle fuel lines. This filter-blocking problem can result in insufficient fuel flow and impaired engine operation, and is especially apparent at low temperatures.

Furthermore, it has unexpectedly been found that fuels containing the preferred ester (Additive D) described in WO 94/17160 shows a loss of lubricity performance following a period of cold storage and filtration. The loss of performance can be apparent even in the absence of severe filter blocking problems. This loss in performance itself represents a significant problem, because under field conditions a stored fuel oil is typically subjected to temperature cycles and must still be able to impart effective lubrication to mechanical devices downstream of the fuel-line filters. In a diesel vehicle fuel system, for example, diesel fuel must first flow through a fine-grade filter before reaching the fuel injection system, including the injection pump. Decreased lubricity performance after this filtration point therefore exposes the injection system to increased wear.

There thus exists a need for improved lubricity additives which demonstrate better filterability and which, in fuel oils, do not show a loss in performance after filtration following periods of cold temperature storage.

Such problems have now surprisingly been solved by additives which comprise specific mixtures of certain esters.

GB-A-1,505,302 describes ester combinations including, for example, glycerol monoesters and glycerol diesters as diesel fuel additives, the combinations being described as leading to advantages including less wear of the fuel-injection equipment, piston rings and cylinder liners. GB-A-1,505,302 is, however, concerned with overcoming the operational disadvantages of corrosion and wear by acidic combustion products, residues in the combustion chamber and in the exhaust system. The document states that these disadvantages are due to incomplete combustion under certain operating conditions. Typical diesel fuels available at the date of the document contained, for example, from 0.5 to 1% by weight of sulphur, as elemental sulphur, based on the weight of the fuel.

U.S. Pat. No. 3,287,273 describes lubricity additives which are reaction products of a dicarboxylic acid and an oil-insoluble glycol. The acid is typically predominantly a dimer of unsaturated fatty acids such as linoleic or oleic acid, although minor proportions of the monomer acid may also be present. Only alkane diols or oxa-alkane diols are specifically suggested as the glycol reactant.

In a first aspect therefore, the invention provides a fuel oil composition comprising a major proportion of a middle distillate fuel oil having a sulphur content of 0.2% by weight or less, and a minor proportion of a lubricity additive comprising:

(a) an ester of an unsaturated monocarboxylic acid and a polyhydric alcohol, and (b) an ester of an unsaturated monocarboxylic acid and a polyhydric alcohol having at least three hydroxy groups, the esters (a) and (b) being different.

In a second aspect, the invention provides the use of the additive defined in the first aspect, for improving the lubricity of a middle distillate fuel oil.

In a third aspect, the invention provides the use of the fuel composition of the first aspect in a combustion apparatus for reducing the wear rate in the fuel supply system of said apparatus.

Another embodiment of this invention is a method for reducing the wear rate in the fuel supply system of a combustion apparatus which employs a middle distillate fuel oil having a sulfur content of 0.2% by weight or less, which comprises adding to said fuel in an amount effective to reduce the wear rate, a minor proportion of a lubricity additive comprising a blend of two different esters prepared respectively from an unsaturated monocarboxylic acid and a polyhydric alcohol, and an unsaturated monocarboxylic acid and a polyhydric alcohol which has at least three hydroxy groups.

The mixture of esters (a) and (b) can provide unexpectedly improved lubricity performance when compared to the individual performance of component (a) or (b). Furthermore, the mixture of (a) and (b) shows improved filterability and maintains good lubricity performance after cold storage followed by filtration.

The invention will now be described in more detail.

The Fuel Oil Composition (First Aspect of the Invention)

(i) The Additive

The term 'polyhydric alcohol' is used to describe a compound having more than one hydroxy-group. It is preferred that (a) is the ester of a polyhydric alcohol having at least three hydroxy groups.

Examples of polyhydric alcohols having at least three hydroxy groups are those having 3 to 10, preferably 3 to 6, more preferably 3 to 4 hydroxy groups and having 2 to 90, preferably 2 to 30, more preferably 2 to 12 and most preferably 3 to 4 carbon atoms in the molecule. Such alcohols may be aliphatic, saturated or unsaturated, and straight chain or branched, or cyclic derivatives thereof. Saturated, aliphatic, straight chain alcohols are preferred.

Advantageously, both (a) and (b) are esters of trihydric alcohols, especially glycerol or trimethylol propane. Other suitable polyhydric alcohols include pentaerythritol, sorbitol, mannitol, inositol, glucose and fructose.

The unsaturated monocarboxylic acids from which the esters are derived may have an alkenyl, cyclo alkenyl or aromatic hydrocarbyl group attached to the carboxylic acid group. The term 'hydrocarbyl' means a group containing carbon and hydrogen which may be straight chain or branched and which is attached to the carboxylic acid group by a carbon—carbon bond. The hydrocarbyl group may be interrupted by one or more hetero atoms such as O, S, N or P.

It is preferred that (a) and (b) are both esters of alkenyl monocarboxylic acids, the alkenyl groups preferably having 10 to 36, for example 10 to 22, more preferably 18–22, especially 18 to 20 carbon atoms. The alkenyl group may be mono- or poly-unsaturated. It is particularly preferred that (a) is an ester of a mono-unsaturated alkenyl monocarboxylic acid, and that (b) is an ester of a poly-unsaturated alkenyl monocarboxylic acid. The poly-unsaturated acid is preferably di- or tri-unsaturated. Such acids may be derived from natural materials, for example vegetable or animal extracts.

Especially-preferred mono-unsaturated acids are oleic and elaidic acid. Especially preferred poly-unsaturated acids are linoleic and linolenic acid.

It has been found that the mixtures wherein (a) is an ester of a mono-unsaturated acid and (b) is an ester of a poly-unsaturated acid have especially good lubricity performance and exhibit particularly good filterability and resistance to cold storage.

The esters may be partial or complete esters, i.e. some or all of the hydroxy groups of each polyhydric alcohol may be esterified. It is preferred that at least one of (a) or (b) is a partial ester, particularly a monoester. Especially good performance is obtained where (a) and (b) are both partial esters and particularly where both are monoesters.

The esters may be prepared by methods well known in the art, for example by condensation reactions. If desired, the alcohols may be reacted with acid derivatives such as anhydrides or acyl chlorides in order to facilitate the reaction and improve yields.

The esters (a) and (b) may be separately prepared and then mixed together, the mixing occuring either prior to addition to the fuel, or as a result of separate addition of (a) and (b) to the fuel at the same or different times. Alternatively, the ester mixture may be prepared directly from a mixture of appropriate starting materials. It has been found that the latter products (i.e. those ester mixtures formed directly from the reaction of a mixture of starting materials) have particularly good filterability and show especially good lubricity performance. In particular, commercially-available mixtures of suitable acids may be reacted with a selected alcohol such as glycerol to form a mixed ester product according to this invention. Particularly-preferred commercial acid mixtures are those comprising oleic and linoleic acids. In such mixtures, a minor proportion of other acids, or acid polymerisation products, may be present but this proportion preferably should not exceed 15%, more preferably not more than 10%, and most preferably not more than 5% by weight of the total acid mixture.

Similarly, mixtures of esters may be prepared by reacting a single acid with a mixture of alcohols.

A highly-preferred ester mixture is that obtained by reacting a mixture of oleic and linoleic acids with glycerol, the mixture comprising predominantly (a) glycerol monooleate and (b) glycerol monolinoleate, preferably in approximately equal proportions by weight.

In addition to the esters (a) and (b), the lubricity additive may further comprise a minor proportion of other esters formed, for example, during esterification of the acid mixtures previously described.

(ii) The Fuel Oil

The fuel oil may be a petroleum-based fuel oil, suitably a middle distillate fuel oil, i.e. a fuel oil obtained in refining crude oil as the fraction between the lighter kerosene and jet fuels fraction and the heavy fuel oil fraction. Such distillate fuel oils generally boil above about 100° C. The fuel oil can comprise atmospheric distillate or vacuum distillate, or cracked gas oil or a blend in any proportion of straight run and thermally and/or catalytically cracked distillates. The most common petroleum-based fuel oils are kerosene, jet fuels and preferably diesel fuel oils.

The sulphur content of the fuel oil is 0.2% by weight or less, preferably 0.05% by weight or less, more preferably 0.01% by weight or less, and most preferably 0.001% by weight or less based on the weight of the fuel oil. The art describes methods for reducing the sulphur content of hydrocarbon middle distillate fuels, such methods including solvent extraction, sulphuric acid treatment, and hydrodesulphurisation.

Preferred fuel oils have a cetane number of at least 40, preferably above 45 and more preferably above 50. The fuel oil may have such cetane numbers prior to the addition of any cetane improver or the cetane number of the fuel may be raised by the addition of a cetane improver.

More preferably, the cetane number of the fuel oil is at least 52.

(iii) Treat Rates

The concentration of the additive in the fuel oil may for example be in the range of 10 to 5,000 ppm of additive (active ingredient) by weight per weight of fuel oil, for example 20 to 5,000 ppm such as 50 to 2000 ppm (active ingredient) by weight per weight of fuel, preferably 75 to 300 ppm, more preferably 100 to 200 ppm.

The relative proportions of (a) and (b) by weight within the fuel oil may be in the range of 1:10 to 10:1, preferably 1:4 to 4:1 and more preferably 1:2 to 2:1. The ratio of 1:1 is most preferred.

The Use of the Additive (Second Aspect of the Invention) and Method (Fourth Aspect of the Invention)

The preferred additives for the second and fourth aspects of the invention are those hereinbefore described in relation to the first aspect.

The fuel oil of the second and fourth aspects of the invention is preferably that hereinbefore described in relation to the first aspect.

The Use of the Fuel Composition (Third Aspect of the Invention)

Where the fuel oil is diesel fuel, the fuel oil composition of the first aspect of the invention finds application in diesel (compression-ignition) engines as a fuel which, in addition to providing good combustion properties, reduces the wear rate in the fuel supply system, and particularly in the fuel injection pump. Use of the fuel thus prolongs the working life of the equipment and reduces the need for replacement of expensive mechanical parts.

The fuel oil composition of the first aspect of the invention similarly finds application in other fuel oil systems wherein the mechanical devices in the fuel supply system are reliant upon the fuel oil for lubrication, and are accordingly subject to wear.

Concentrates

Concentrates comprising the additive in admixture with a carrier liquid (e.g. as a solution or a dispersion) are convenient as a means for incorporating the additive into bulk fuel oil, which incorporation may be done by methods known in the art. The concentrates may also contain other additives as required and preferably contain from 3 to 75 wt %, more preferably 3 to 60 wt %, most preferably 10 to 50 wt % of the additives preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; paraffinic hydrocarbons such as hexane and pentane and isoparaffins; and oxygenated solvents such as alcohols. The carrier liquid must, of course, be selected having regard to its compatibility with the additive and with the fuel. The concentrates are added to the bulk fuel oil in amounts sufficient to supply the treat rate of additive hereinbefore indicated.

The additives of the invention may be incorporated into bulk fuel oil by other methods such as those known in the art. If co-additives are required, they may be incorporated into the bulk fuel oil at the same time as the additives of the invention or at a different time.

Co-additives

The fuel composition of the first aspect of the invention may additionally comprise other known lubricity-enhancing compounds as co-additives, for example mono- or polycarboxylic acids, such as dicarboxylic acids. These acids are preferably mixtures of polymerised unsaturated fatty acids, comprising mainly dimer and some trimer acid, with minor proportions of monomer and/or higher polymers. Typical examples are the dimer acids of oleic acid, linoleic acid or mixtures thereof. Esters of these acids with monohydric or dihydric alcohols may also be used in combination with the mixture of esters (a) and (b), to give further improved additives.

Similarly, ethoxylated-amine type lubricity co-additives may be used.

The fuel oil of the first aspect of the invention may also advantageously comprise one or more fuel oil cold flow improvers, as co-additives, such as one or more of:

(i) ethylene-unsaturated ester copolymers,
(ii) hydrocarbon polymers,
(iii) sulphur carboxy compound,
(iv) polar compounds,
(v) hydrocarbylated aromatics,
(vi) linear compounds, and
(vii) comb polymers as hereinafter defined.

(i) Ethylene-Unsaturated Ester Copolymer

Ethylene copolymer flow improvers e.g. ethylene unsaturated ester copolymer flow improvers, have a polymethylene backbone divided into segments by hydrocarbyl side chains interrupted by one or more oxygen atoms and/or carbonyl groups.

More especially, the copolymer may comprise an ethylene copolymer having, in addition to units derived from ethylene, units of the formula $$—CR^5R^6—CHR^7—$$

wherein $R^6$ represents hydrogen or a methyl group; $R^5$ represents a $—OOCR^8$ or $—COOR^8$ group wherein $R^8$ represents hydrogen or a $C_1$ to $C_9$, preferably $C_1$ to $C_6$, more preferably $C_1$ to $C_3$, straight or branched chain alkyl group; and $R^7$ represents hydrogen or a $—COOR^8$ or $—OOCR^8$ group.

These may comprise a copolymer of ethylene with an ethylenically unsaturated ester, or derivatives thereof. An example is a copolymer of ethylene with an ester of an unsaturated carboxylic acid such as ethylene-acrylates (e.g. ethylene -2-ethylhexylacrylate), but the ester is preferably one of an unsaturated alcohol with a saturated carboxylic acid such as described in GB-A-1,263,152. An ethylene-vinyl ester copolymer is advantageous; an ethylene-vinyl acetate, ethylene vinyl propionate, ethylene-vinyl hexanoate, ethylene 2-ethylhexanoate, or ethylene-vinyl octanoate copolymer is preferred. Preferably, the copolymers contain from 1 to 25 such as less than 25, e.g. 1 to 20, mole % of the vinyl ester, more preferably from 3 to 15 mole % vinyl ester. They may also be in the form of mixtures of two copolymers such as those described in U.S. Pat. No. 3,961,916 and EP-A-113,581. Preferably, number average molecular weight, as measured by vapour phase osmometry, of the copolymer is 1,000 to 10,000, more preferably 1,000 to 5,000. If desired, the copolymers may be derived from additional comonomers, e.g. they may be terpolymers or tetrapolymers or higher polymers, for example where the additional comonomer is isobutylene or diisobutylene or another ester giving rise to different units of the above formula and wherein the above-mentioned mole %'s of ester relate to total ester.

Also, the copolymers may include small proportions of chain transfer agents and/or molecular weight modifiers (e.g. acetaldehyde or propionaldehyde) that may be used in the polymerisation process to make the copolymer.

The copolymers may be made by direct polymerisation of comonomers. Such copolymers may also be made by transesterification, or by hydrolysis and re-esterification, of an ethylene unsaturated ester copolymer to give a different ethylene unsaturated ester copolymer. For example, ethylene vinyl hexanoate and ethylene vinyl octanoate copolymers may be made in this way, e.g. from an ethylene vinyl acetate copolymer.

The copolymers may, for example, have 15 or fewer, preferably 10 or fewer, more preferably 6 or fewer, most preferably 2 to 5, methyl terminating side branches per 100 methylene groups, as measured by nuclear magnetic resonance, other than methyl groups on a comonomer ester and other than terminal methyl groups.

The copolymers may have a polydispersity of 1 to 6 preferably 2 to 4, polydispersity being the ratio of weight average molecular wright to number average molecular wright both as measured by Gel Permeation Chromatography using polystyrene standards.

(ii) Hydrocarbon Polymers

Linear Hydrocarbon Polymers

These have one or more polymethylene backbones, optionally divided into segments by short chain length hydrocarbyl groups, i.e. of 5 or less carbon atoms.

Examples are those represented by the following general formula $$\left(\mathrm{CTT-CHT}\right)_v\left(\mathrm{CHU-CHU}\right)_w$$

where T represents H or $R^1$;

U represents H, T or substituted or unsubstituted aryl; and $R^1$ represents a hydrocarbyl group having up to 5 carbon atoms.

and v and w represent mole ratios, v being within the range 1.0 to 0.0, w being within the range 0.0 to 1.0. Preferably, $R^1$ is a straight or branched chain alkyl group.

These polymers may be made directly from ethylenically unsaturated monomers or indirectly by hydrogenating the polymer made from monomers such as isoprene and butadiene.

Preferred hydrocarbon polymers are copolymers of ethylene and at least one α-olefin. Examples of such olefins are propylene, 1-butene, isobutene, and 2,4,4-trimethylpent-2-ene. The copolymer may also comprise small amounts, e.g. up to 10% by weight of other copolymerizable monomers, for example olefins other than α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is less than 150,000, as measured by gel permeation chromatography (GPC) relative to polystyrene standards. For some applications, it is advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000. For other applications, it is below 30,000, preferably below 15,000 such as below 10,000 or below 6,000.

Advantageously, the copolymer has a molar ethylene content between 50 and 85 percent. More advantageously, the ethylene content is within the range of from 55 to 80%, and preferably it is in the range from 55 to 75%; more preferably from 60 to 70%, and most preferably 65 to 70%.

Examples of ethylene-α-olefin copolymers are ethylene-propylene copolymers with a molar ethylene content of from 60 to 75% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. Advantageously, the polymers are substantially amorphous, since highly crystalline polymers are relatively insoluble in fuel oil at low temperatures.

(iii) Sulphur Carboxy Compounds

Examples are those described in EP-A-0,261,957 which describes the use of compounds of the general formula

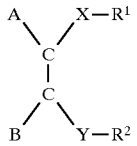

in which —Y—$R^2$ is $SO_3^{(-)(+)}NR_3^3R^2$, —$SO_3^{(-)(+)}HNR_2^3R^2$, —$SO_3^{(-)(+)}H_2NR^3R^2$, —$SO_3^{(-)(+)}H_3NR^2$, —$SO_2NR^3R^2$ or —$SO_3R^2$; and —X—$R^1$ is —Y—$R^2$ or —$CONR^3R^1$, —$CO_2^{(-)(+)}NR_3^3R^1$, —$CO_2^{(-)(+)}HNR_2^3R^1$, —$R^4$—$COOR_1$, —$NR^3COR^1$, —$R^4OR^1$, —$R^4OCOR^1$, —$R^4$,$R^1$, —$N(COR^3)R^1$ or $Z^{(-)(+)}NR_3^3R^1$; —$Z^{(-)}$ is $SO_3^{(-)}$ or —$CO_2^{(-)}$;

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

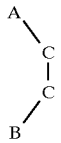

the carbon—carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that X—$R^1$ and Y—$R^2$ between them contain at least three alkyl, alkoxyalkyl or polyalkoxyalkyl groups.

Multicomponent additive systems may be used and the ratios of additives to be used will depend on the fuel to be treated.

(iv) Polar Compounds

Such compounds comprise an oil-soluble polar nitrogen compound carrying one or more, preferably two or more, hydrocarbyl substituted amino or imino substituents, the hydrocarbyl group(s) being monovalent and containing 8 to 40 carbon atoms, which substituent or one or more of which substituents optionally being in the form of a cation derived therefrom. The oil-soluble polar nitrogen compound is either ionic or non-ionic and is capable of acting as a wax crystal growth modifier in fuels. Preferably, the hydrocarbyl group is linear or slightly linear, i.e. it may have one short length (1–4 carbon atoms) hydrocarbyl branch. When the substituent is amino, it may carry more than one said hydrocarbyl group, which may be the same or different.

The term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen.

More especially, the or each amino or imino substutent is bonded to a moiety via an intermediate linking group such as —CO—, —$CO_2^{(-)}$, —$SO_3^{(-)}$ or hydrocarbylene. Where the linking group is anionic, the substituent is part of a cationic group, as in an amine salt group.

When the polar nitrogen compound carries more than one amino or imino substituent, the linking groups for each substituent may be the same or different.

Suitable amino substituents are long chain $C_{12}$–$C_{40}$, preferably $C_{12}$–$C_{24}$, alkyl primary, secondary, tertiary or quaternary amino substituents.

Preferably, the amino substituent is a dialkylamino substituent, which, as indicated above, may be in the form of an amine salt thereof; tertiary and quaternary amines can form only amine salts. Said alkyl groups may be the same or different.

Examples of amino substituents include dodecylamino, tetradecylamino, cocoamino, and hydrogenated tallow amino. Examples of secondary amino substituents include dioctadecylamino and methylbehenylamino. Mixtures of amino substituents may be present such as those derived from naturally occurring amines. A preferred amino substituent is the secondary hydrogenated tallow amino substituent, the alkyl groups of which are derived from hydrogenated tallow fat and are typically composed of approximately 4% $C_{14}$, 31% $C_{16}$ and 59% $C_{18}$ n-alkyl groups by weight.

Suitable imino substituents are long chain $C_{12}$–$C_{40}$, preferably $C_{12}$–$C_{24}$, alkyl substituents.

Said moiety may be monomeric (cycylic or non-cyclic) or polymeric. When non-cyclic, it may be obtained from a cyclic precursor such as an anhydride or a spirobislactone.

The cyclic ring system may include homocyclic, heterocyclic, or fused polycyclic assemblies, or a system where two or more such cyclic assemblies are joined to one another and in which the cyclic assemblies may be the same or different. Where there are two or more such cyclic assemblies, the substituents may be on the same or different assemblies, preferably on the same assembly. Preferably, the or each cyclic assembly is aromatic, more preferably a benzene ring. Most preferably, the cyclic ring system is a single benzene ring when it is preferred that the substituents are in the ortho or meta positions, which benzene ring may be optionally further substituted.

The ring atoms in the cyclic assembly or assemblies are preferably carbon atoms but may for example include one or more ring N, S or O atom, in which case or cases the compound is a heterocyclic compound.

Examples of such polycyclic assemblies include (a) condensed benzene structures such as naphthalene, anthracene, phenanthrene, and pyrene;

(b) condensed ring structures where none of or not all of the rings are benzene such as azulene, indene, hydroindene, fluorene, and diphenylene oxides:

(c) rings joined "end-on" such as diphenyl;

(d) heterocyclic compounds such as quinoline, indole, 2:3 dihydroindole, benzofuran, coumarin, isocoumarin, benzothiophen, carbazole and thiodiphenylamine;

(e) non-aromatic or partially saturated ring systems such as decalin (i.e. decahydronaphthalene), a-pinene, cardinene, and bornylene; and (f) three-dimensional structures such as norbornene, bicycloheptane (i.e. norbornane), bicyclooctane, and bicyclooctene.

Examples of polar nitrogen compounds are described below:

(I) an amine salt and/or amide of a mono- or polycarboxylic acid, e.g. having 1 to 4 carboxylic acid groups. It may be made, for example, by reacting at least one molar proportion of a hydrocarbyl substituted amine with a molar proportion of the acid or its anhydride.

When an amide is formed, the linking group is —CO—, and when an amine salt is formed, the linking group is —$CO_2^{(-)}$.

The moiety may be cyclic or non-cyclic. Examples of cyclic moieties are those where the acid is cyclohexane 1,2-dicarboxylic acid; cyclohexane 1,2-dicarboxylic acid; cyclopentane 1,2-dicarboxylic acid; and naphthalene dicarboxylic acid. Generally, such acids have 5 to 13 carbon atoms in the cyclic moiety. Preferred such cyclic acids are benzene dicarboxylic acids such as phthalic acid, isophthalic acid, and terephthalic acid, and benzene tetracarboxylic acids such as pyromelletic acid, phthalic acid being particularly preferred. U.S. Pat. No. 4,211,534 and EP-A-272,889 describes polar nitrogen compounds containing such moieties.

Examples of non-cyclic moieties are those when the acid is a long chain alkyl or alkylene substituted dicarboxylic acid such as a succinic acid, as described in U.S. Pat. No. 4,147,520 for example.

Other examples of non-cyclic moieties are those where the acid is a nitrogen-containing acid such as ethylene diamine tetracetic acid.

Further examples are the moieties obtained where a dialkyl spirobislactone is reacted with an amine.

(II) EP-A-0,261,957 describes polar nitrogen compounds according to the present description of the general formula

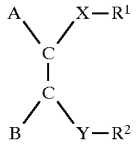

in which —Y—$R^2$ is $SO_3^{(-)(+)}NR_3R^2$, —$SO_3^{(-)(+)}HNR_2{}^3R^2$, —$SO_3^{(-)(+)}H_2NR^3R^2$, —$SO_3^{(-)(+)}H_3NR^2$, —$SO_2NR^3R^2$ or —$SO_3R^2$; and —X—$R^1$ is —Y—$R^2$ or —$CONR^3R^1$, —$CO_2^{(-)(+)}NR_3{}^3R^1$, —$CO_2^{(-)(+)}HNR_2{}^3R^1$, —$R^4$—$COOR_1$, —$NR^3COR^1$, —$R^4OR^1$, —$R^4OCOR^1$, —$R^4$,$R^1$, —N($COR^3$)$R^1$ or $Z^{(-)(+)}NR_3{}^3R^1$; —$Z^{(-)}$ is $SO_3^{(-)}$ or —$CO_2^{(-)}$;

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

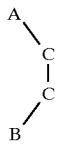

the carbon—carbon (C—C) bond is either a) ethylenically unsaturated when A and B may be alkyl, alkenyl or substituted hydrocarbyl groups or b) part of a cyclic structure which may be aromatic, polynuclear aromatic or cycloaliphatic, it is preferred that X—$R^1$ and Y—$R^2$ between them contain at least three alkyl, alkoxyalkyl or polyalkoxyalkyl groups.

Multicomponent additive systems may be used and the ratios of additives to be used will depend on the fuel to be treated.

(III) EP-A-0,316,108 describes an amine or diamine salt of (a) a sulphosuccinic acid, b) an ester or diester of a sulphosuccinic acid, c) an amide or a diamide of a sulphosuccinic acid, or d) an ester-amide of a sulphosuccinic acid.

(IV) A chemical compound comprising or including a cyclic ring system, the compound carrying at least two substituents of the general formula (I) below on the ring system $$—A—NR^1R^2 \quad (I)$$

where A is an aliphatic hydrocarbyl group that is optionally interrupted by one or more hetero atoms and that is straight chain or branched, and $R^1$ and $R^2$ are the same or different and each is independently a hydrocarbyl group containing 9 to 40 carbon atoms optionally interrupted by one or more hetero atoms, the substituents being the same or different and the compound optionally being in the form of a salt thereof.

Preferably, A has from 1 to 20 carbon atoms and is preferably a methylene or polymethylene group.

Each hydrocarbyl group constituting $R^1$ and $R^2$ in the invention (Formula 1) may for example be an alkyl or alkylene group or a mono- or poly-alkoxyalkyl group. Preferably, each hydrocarbyl group is a straight chain alkyl group. The number of carbon atoms in each hydrocarbyl group is preferably 16 to 40, more preferably 16 to 24.

Also, it is preferred that the cyclic system is substituted with only two substituents of the general formula (I) and that A is a methylene group.

Examples of salts of the chemical compounds are the acetate and the hydrochloride.

The compounds may conveniently be made by reducing the corresponding amide which may be made by reacting a secondary amine with the appropriate acid chloride.

(V) A condensate of long chain primary or secondary amine with a carboxylic acid-containing polymer.

Specific examples include polymers such as described in GB-A-2,121,807, FR-A-2,592,387 and DE-A-3,941,561; and also esters of telemer acid and alkanoloamines such as described in U.S. Pat. No. 4,639,256; and the reaction product of an amine containing a branched carboxylic acid ester, an epoxide and a mono-carboxylic acid polyester such as described in U.S. Pat. No. 4,631,071.

EP-0,283,292 describes amide containing polymers and EP-0,343,981 describes amine-salt containing polymers.

It should be noted that the polar nitrogen compounds may contain other functionality such as ester functionality.

(v) Hydrocarbylated Aromatics

These material are condensates comprising aromatic and hydrocarbyl parts. The aromatic part is conveniently an aromatic hydrocarbon which may be unsubstituted or substituted with, for example, non-hydrocarbon substitutents.

Such aromatic hydrocarbon preferably contains a maximum of these substituent groups and/or three condensed rings, and is preferably naphthalene. The hydrocarbyl part is a hydrogen and carbon containing part connected to the rest of the molecule by a carbon atom. It may be saturated or unsaturated, and straight or branched, and may contain one or more hetero-atoms provided they do not substantially affect the hydrocarbyl nature of the part. Preferably the hydrocarbyl part is an alkyl part, conveniently having more than 8 carbon atoms.

(vi) Linear Compounds

Such compounds comprise a compound in which at least one substantially linear alkyl group having 10 to 30 carbon atoms is connected via an optional linking group that may be branched to a non-polymeric residue, such as an organic residue, to provide at least one linear chain of atoms that includes the carbon atoms of said alkyl groups and one or more non-terminal oxygen, sulphur and/or nitrogen atoms. The linking group may be polymeric.

By "substantially linear" is meant that the alkyl group is preferably straight chain, but that straight chain alkyl groups having a small degree of branching such as in the form of a single methyl group branch may be used.

Preferably, the compound has at least two of said alkyl groups when the linear chain may include the carbon atoms of more than one of said alkyl groups. When the compound has at least three of said alkyl groups, there may be more than one of such linear chains, which chains may overlap. The linear chain or chains may provide part of the linking group between any two such alkyl groups in the compound.

The oxygen atom or atoms, if present, are preferably directly interposed between carbon atoms in the chain and may, for example, be provided in the linking group, if present, in the form of a mono- or poly-oxyalkylene group, said oxyalkylene group preferably having 2 to 4 carbon atoms, examples being oxyethylene and oxypropylene.

As indicated the chain or chains include carbon, oxygen, sulphur and/or nitrogen atoms.

The compound may be an ester where the alkyl groups are connected to the remainder of the compound as —O—CO n alkyl, or —CO—O n alkyl groups, in the former the alkyl groups being derived from an acid and the remainder of the compound being derived from a polyhydric alcohol and in the latter the alkyl groups being derived from an alcohol and the remainder of the compound being derived from a polycarboxylic acid. Also, the compound may be an ether where the alkyl groups are connected to the remainder of the compound as —O—n—alkyl groups. The compound may be both an ester and an ether or it may contain different ester groups.

Examples include polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkylene group in said polyoxyalkylene glycol containing from 1 to 4 carbon atoms, as described in EP-A-61 895 and in U.S. Pat. No. 4,491,455.

The preferred esters, ethers or ester/ethers which may be used may comprise compounds in which one or more groups (such as 2, 3 or 4 groups) of formula —$OR^{25}$ are bonded to a residue E, where E may for example represent A (alkylene) q, where A represents C or N or is absent, q represents an integer from 1 to 4, and the alkylene group has from one to four carbon atoms, A (alkylene)q for example being $N(CH_2CH_2)_3$; $C(CH_2)_4$; or $(CH_2)_2$; and $R^{25}$ may independently be (a) n-alkyl- (b) n-alkyl-CO—

(c) n-alkyl-OCO—$(CH_2)$n—

(d) n-alkyl-OCO—$(CH_2)_n$CO— n being, for example, 1 to 34, the alkyl group being linear and containing from 10 to 30 carbon atoms. For example, they may be represented by the formula $R^{23}OBOR^{24}$, $R^{23}$ and $R^{24}$ each being defined as for $R^{25}$ above, and B representing the polyalkylene segment of the glycol in which the alkylene group has from 1 to 4 carbon atoms, for example, polyoxymethylene, polyoxyethylene or polyoxytrimethylene moiety which is substantially linear; some degree of branching with lower alkyl side chains (such as in polyoxypropylene glycol) may be tolerated but it is preferred that the glycol should be substantially linear.

Suitable glycols generally are substantially linear polyethylene glycols (PEG) and polypropylene glycols (PPG) having a molecular weight of about 100 to 5,000, preferably about 200 to 2,000. Esters are preferred and fatty acids containing from 10 to 30 carbon atoms are useful for reacting with the glycols to form the ester additives, it being preferred to use $C_{18}$ to $C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred when the petroleum based component is a narrow boiling distillate, when minor amounts of monoethers and monoesters (which are often formed in the manufacturing process) may also be present. It is important for active performance that a major amount of the dialkyl compound is present. In particular, stearic or behenic diesters of polyethylene glycol, polypropylene glycol or polyethylene/polypropylene glycol mixtures are preferred.

Examples of other compounds in this general category are those described in Japanese Patent Publication Nos. 2-51477 and 3-34790, and EP-A-117,108 and EP-A-326,356, and cyclic esterified ethoxylates such as described EP-A-356,256.

(vii) Comb Polymers

Comb polymers are discussed in "Comb-Like Polymers. Structure and Properties", N. A. Platé and V. P. Shibaev, J. Poly. Sci. Macromolecular Revs., 8, p 117 to 253 (1974).

Generally, comb polymers consist of molecules in which long chain branches such as hydrocarbyl branches, optionally interrupted with one or more oxygen atoms and/or carbonyl groups, having from 6 to 30 such as 10 to 30, carbon atoms, are pendant from a polymer backbone, said branches being bonded directly or indirectly to the backbone. Examples of indirect bonding include bonding via interposed atoms or groups, which bonding can include covalent and/or electrovalent bonding such as in a salt. Generally, comb polymers are distinguished by having a minimum molar proportion of units containing such long chain branches.

Advantageously, the comb polymer is a homopolymer having, or a copolymer at least 25 and preferably at least 40, more preferably at least 50, molar percent of the units of which have, side chains containing at least 6 such as at least 8, and preferably at least 10, atoms, selected from for example carbon, nitrogen and oxygen, in a linear chain or a chain containing a small amount of branching such as a single methyl branch.

As examples of preferred comb polymers there may be mentioned those containing units of the general formula $$\text{(CDE—CHG)}_m\text{(CJK—CHL)}_n$$

where

D represents $R^{11}$, $COOR^{11}$, $OCOR^{11}$, $R^{12}COOR^{11}$ or $OR^{11}$;

E represents H, D or $R^{12}$;

G represents H or D;

J represents H, $R^{12}$, $R^{12}COOR^{11}$, or a substituted or unsubstituted aryl or heterocyclic group;

K represents H, $COOR^{12}$, $OCOR^{12}$, $OR^{12}$ or COOH;

L represents H, $R^{12}$, $COOR^{12}$, $OCOR^{12}$ or substituted or unsubstituted aryl;

$R^{11}$ representing a hydrocarbyl group having 10 or more carbon atoms, and $R^{12}$ representing a hydrocarbyl group being divalent in the $^{12}COOR^{11}$group and otherwise being monovalent, and m and n represent mole ratios, their sum being 1 and m being finite and being up to and including 1 and n being from zero to less than 1, preferably m being within the range of from 1.0 to 0.4, n being in the range of from 0 to 0.6. $R^{11}$ advantageously represents a hydrocarbyl group with from 10 to 30 carbon atoms, preferably 10 to 24, more preferably 10 to 18. Preferably, $R^{11}$ is a linear or slightly branched alkyl group and $R^{12}$ advantageously represents a hydrocarbyl group with from 1 to 30 carbon atoms when monovalent, preferably with 6 or greater, more preferably 10 or greater, preferably up to 24, more preferably up to 18 carbon atoms. Preferably, $R^{12}$, when monovalent, is a linear or slightly branched alkyl group. When $R^{12}$ is divalent, it is preferably a methylene or ethylene group. By "slightly branched" is meant having a single methyl branch.

The comb polymer may contain units derived from other monomers if desired or required, examples being CO, vinyl acetate and ethylene. It is within the scope of the invention to include two or more different comb copolymers.

The comb polymers may, for example, be copolymers of maleic anhydride or fumaric acid and another ethylenically unsaturated monomer, e.g. an α-olefin or an unsaturated ester, for example, vinyl acetate as described in EP-A-214,786. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, 1-octadecene, and styrene. Other examples of comb polymer include methacrylates and acrylates.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan- 1-ol, n-hexadecan-1-ol, and n-octadecan-1-ol. The alcohols may also include up to one methyl branch per chain, for example, 1-methylpentadecan-1-ol, 2-methyltridecan-1-ol as described in EP-A-213,879. The alcohol may be a mixture of normal and single methyl branched alcohols. It is preferred to use pure alcohols rather than alcohol mixtures such as may be commerically available; if mixtures are used the number of carbon atoms in the alkyl group is taken to be the average number of carbon atoms in the alkyl groups of the alcohol mixture; if alcohols that contain a branch at the 1 or 2 positions are used the number of carbon atoms in the alkyl group is taken to be the number in the straight chain backbone segment of the alkyl group of the alcohol.

The comb polymers may especially be fumarate or itaconate polymers and copolymers such as for example those described in European Patent Applications 153 176, 153 177, 156 577 and 225 688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred fumarate comb polymers may, for example, have a number average molecular weight in the range of 1,000 to 100,000, preferably 1,000 to 50,000, as measured by Vapour Phase Osmometry (VPO).

Other suitable comb polymers are the polymers and copolymers of α-olefins and esterified copolymers of styrene and maleic anhydride, and esterified copolymers of styrene and fumaric acid as described in EP-A-282,342; mixtures of two or more comb polymers may be used in accordance with the invention and, as indicated above, such use may be advantageous.

Other examples of comb polymers are hydrocarbon polymers such as copolymers of ethylene and at least one α-olefin, preferably the α-olefin having at most 20 carbon atoms, examples being n-octene-1, iso octene-1, n-decene-1 and n-dodecene-1, n-tetradecene-1 and n-hexadecene-1 (for example, as described in WO9319106. Preferably, the number average molecular weight measured by Gel Permeation Chromatography against polystyrene standards of such a copolymer is for example, up to 30,000 or up to 40,000. The hydrocarbon copolymers may be prepared by methods known in the art, for example using a Ziegler type catalyst. Such hydrocarbon polymers may for example have an isotacticity of 75% or greater.

Some of the hereinbefore described cold flow improver co-additives may provide synergistic enhancements to lubricity performance when in combination with the mixture of esters (a) and (b).

Further co-additives which may be used are those known in the art, for example detergents, antioxidants, corrosion inhibitors, dehazers, demulsifiers, metal deactivators, anti-foaming agents, combustion improvers such as cetane improvers, co-solvents, package compatibilisers, reodorants and metallic-based additives such as metallic combustion improvers.

Assessment of the Benefits of the Various Aspects of the Invention

It is believed that the mixture of esters (a) and (b) is capable of forming at least partial layers of a lubricating composition on certain metal surfaces. By this is meant that the layer formed is not necessarily complete on the contacting surface. The formation of such layers and the extent of their coverage of a contacting surface can be demonstrated by, for example, measuring electrical contact resistance or electrical capacitance.

A test that can be used to demonstrate one or more of a reduction in wear, a reduction in friction or an increase in electrical contact resistance according to this invention is the High Frequency Reciprocating Rig test (or "HFRR"), described in the standard test methods CEC PF 06-T-94 or ISO/TC22/SC7/WG6/N188.

The extent to which an additive composition causes blocking of fuel oil line filters can be measured using a known filterability test. For example, a method for measuring the filterability of fuel oil compositions is described in the Institute of Petroleum's Standard designated "IP 387/190" and entitled "Determination of filter blocking tendency of gas oils and distillate diesel fuels". In summary, a sample of the fuel oil composition to be tested is passed at a constant rate of flow through a glass fibre filter medium; the pressure drop across the filter is monitored, and the volume of fuel oil passing the filter medium within a prescribed pressure drop is measured. The filter blocking tendency of a fuel composition can be described as the pressure drop across the filter medium for 300 ml of fuel to pass at a rate of 20 ml/min. Reference is to be made to the above-mentioned Standard for further information. In assessing the additive composition of the present invention this method was adapted by conducting the measurements at various temperatures lower than that specified in the Standard, to simulate cold storage conditions which occur in the field.

The invention is further illustrated by reference to the following Examples.

EXAMPLE 1

The following materials and procedures were used.

Fuel Oil

A 'Class I' diesel fuel oil having the characteristics shown below:

| | | |
|---|---|---|
| Sulphur: | 4.5 ppm wt/wt | |
| Cetane Number: | 51.6 | |
| CFPP (Auto) | −36° C. | |
| Distillation: | 50% Evaporation | 237.1° C. |
| | Final Boiling Point | 294.1° C. |
| | Residue (% vol.) | 1.2 |

Additives

Additives A, B, C and D were added to the diesel fuel oil in the amounts recorded in Table 1, and the filterability of each of the fuel compositions was assessed according to the IP 387/90 test at the temperatures shown in Table 1. In each case, after thorough mixing, the sample fuel composition was cooled to the required temperature in a refrigeration unit and stored at that temperature for the stated period of time before being subject to the filtration test.

TABLE 1

| | | Additive Concentration | Filterability Test Result | | | | | |
|---|---|---|---|---|---|---|---|---|
| | | (ppm active | At 0° C. | | | At −10° C. | | At −5° C. |
| Sample | Additive | Ingredient, wt/wt) | 1 day | 1 week | 1 month | 1 day | 1 week | 2 weeks |
| 1 | None | Nil | 9.653 kPa (1.4 psi) | 13.79 kPa (2.0 psi) | — | 15.17 kPa (2.2 psi) | 13.79 kPa (2.0 psi) | 18.62 kPa (2.7 psi) |
| 2 | A | 200 | 11.032 kPa (1.6 psi) | 11.72 kPa (1.7 psi) | 13.10 kPa (1.9 psi) | 15.17 kPa (2.2 psi) | 14 min 28 s | 21.38 kPa (3.1 psi) |

TABLE 1-continued

| Sample | Additive | Additive Concentration (ppm active Ingredient, wt/wt) | Filterability Test Result At 0° C. 1 day | At 0° C. 1 week | At 0° C. 1 month | At −10° C. 1 day | At −10° C. 1 week | At −5° C. 2 weeks |
|---|---|---|---|---|---|---|---|---|
| 3 | B | 200 | 6.895 kPa (1.0 psi) | 8.27 kPa (1.2 psi) | 5 min, 39 s | 7 min, 14 s | 1 min, 2 s | 12 min, 2 s |
| 4 | C | 200 | — | — | — | — | — | 6 min, 20 s |
| 5 | D | 200 | — | — | — | — | — | 96.54 kPa (14 psi) |

Footnote: '—'means not measured

Additive A was prepared by esterification of a commercial mixture of oleic and linoleic acids with glycerol, to produce a mixed ester product predominating in (a) glycerol monooleate and (b) glycerol monolinoleate, in approximately equal proportions by weight, with minor amounts of glycerol di- and trioleate and linoleate also present. In addition, the acid mixture contained a minor proportion of other acids, the esters of which were not believed to represent more than about 6% by weight of the mixed ester product.

Additive B was prepared by esterification of oleic acid with glycerol, to form a product predominating in glycerol monooleate (Additive D of WO 94/17160).

Additive C was prepared by esterification of linoleic acid with glycerol, to form a product predominating in glycerol monolinolate.

Additive D was a 1:1 molar mixture of Additive B and Additive C.

In Table 1, the test results indicate the pressure drop over the filter at the end of each test, higher pressure drops indicating a greater degree of partial filter blocking. Where the pressure drop became larger than 103.4 kPa (15 psi) during the 15 minute test, the test time at which this pressure was reached was recorded (103.4 kPa, i.e. 15 psi, corresponds to severe filter blocking and is regarded for these purposes as a test 'fail').

It can be seen from the results in Table 1 that Sample 2 (fuel composition of the invention) showed surprisingly improved filterability over Sample 3 (comparative fuel composition containing additive D of WO 94/17160), both at 0° C. and −10° C. Furthermore, although both examples exceeded 103.4 kPa in the test after 1 week at −10° C., Sample 2 was a better performer (exceeded just before the end of the 15 minute test in contrast to Sample 3 which exceeded this pressure drop almost immediately).

Furthermore, the results at −5° C. indicate that Samples 2 and 5 (fuel compositions of the invention) showed greatly improved filterability over Samples 3 and 4 (comparatives), these two comparative examples both failing the test. Sample 2 containing Additive A (made by esterifying a mixture of starting acids) also showed surprisingly improved performance in comparison to Sample 5 containing Additive D (made by mixing together the component esters).

EXAMPLE 2

A small aliquot of each of the Samples of Example 1 stored at −5° C. for 2 weeks was removed immediately prior to the filtration step described in Example 1, and the HFRR performance at 60° C. of each aliquot measured as an indication of 'pre-filtration' lubricity performance. The HFRR performance at 60° C. of each corresponding sample filtrate produced in Example 1 was also measured as an indication of 'post-filtration' lubricity performance. The results are compared in Table 2 below.

TABLE 2

| Sample | Additive | Additive Concentration (ppm active ingredient, wt/wt) | HFRR Wear Scar Before Filtration (μm) | HFRR Wear Scar After Filtration (μm) |
|---|---|---|---|---|
| 1 | None | Nil | 623 | 610 |
| 2 | A | 200 | 309 | 330 |
| 3 | B | 200 | 249 | 396 |
| 4 | C | 200 | 343 | 411 |
| 5 | D | 200 | 292 | 274 |

The results in Table 2 indicate that Samples 3 and 4 (comparatives) show significantly poorer lubricity performance after filtration (i.e. a larger wear scar), in contrast to Samples 2 and 5 (fuel compositions of the invention) which maintained their lubricity performance.

The untreated fuel (Sample 1) showed no change, confirming that the differences in the results of other samples are due to the additives present in these compositions.

The differences in wear scar diameter after filtration indicate a significant technical improvement and demonstrate the improved lubricity properties provided by mixtures of esters (a) and (b), over comparative additives.

I claim:

1. A fuel oil composition comprising a major proportion of a middle distillate fuel oil having a sulphur content of 0.2% by weight or less, and a minor proportion of a lubricity additive comprising (a) an ester of an unsaturated monocarboxylic acid and a polyhydric alcohol, and (b) an ester of a polyunsaturated monocarboxylic acid and a polyhydric alcohol having at least three hydroxy groups, the esters (a) and (b) being different.

2. The composition of claim 1 wherein the fuel oil has a sulphur content of 0.01% by weight or less.

3. The composition of claim 1 wherein the fuel oil is diesel fuel.

4. The composition of claim 1, wherein (a) is an ester of a polyhydric alcohol having at least three hydroxy groups.

5. The composition of claim 4 wherein (b) is an ester of polyhydric alcohol having at least three hydroxyl groups and wherein the polyhydric alcohol of each of (a) and (b) is a saturated, aliphatic, straight claim alcohol having 3 or 4 hydroxyl groups and 3 or 4 carbon atoms.

6. The composition of claim 4, wherein (a) and (b) are esters of alkenyl monocarboxylic acids.

7. The composition of claim 6 wherein alkenyl of each of the monocarboxylic acids contain from 18 to 22 carbon atoms.

8. The composition of claim 5 wherein (b) is an ester of a di- or tri-unsaturated alkenyl monocarboxylic acid.

9. The composition of claim 6 wherein both acids have alkenyl groups of 10 to 36 carbon atoms.

10. The composition of claim 9 wherein (a) and (b) are both esters of trihydric alcohols.

11. The composition of claim 10 wherein (a) and (b) are both esters of glycerol.

12. The composition of claim 10 wherein (a) and (b) are both mono-esters.

13. The composition of claim 12 wherein (a) is a mono-ester of oleic acid and glycerol, and (b) is a mono-ester of linoleic acid and glycerol.

14. The composition of claim 13 wherein the relative proportions of (a) and (b) by weight is in the range of from about 1:4 to 4:1.

15. A fuel oil composition comprising a major proportion of middle distillate diesel fuel oil having a sulfur content of 0.01% by weight or less, and from about 75 to 300 ppm (active ingredient) by weight of (a) a monoester of oleic acid and glycerol, and (b) a monoester of linoleic acid and glycerol, and wherein the relativem proportion of (a) to (b) by weight is about 1:1.

16. A method of improving the lubricant of a middle distillate fuel oil having a sulfur content of 0.2% by weight or less, said method comprising adding to said middle distillate fuel oil from about 10 to 500 ppm (active ingredient) of a lubricity additive comprising (a) an ester or an unsaturated monocarboxylic acid and a polyhydric alcohol, and (b) an ester of a polyunsaturated monocarboxylic acid and a polyhydric alcohol having at least three hydroxy groups, the esters (a) and (b) being different.

17. The method of claim 16 wherein the middle distillate fuel oil is a diesel fuel.

18. The method of claim 17 wherein (a) is a mono-ester of oleic acid and glycerol, and (b) is a mono-ester of linoleic acid and glycerol.

19. A method of reducing the wear rate in a fuel supply system of a combustion apparatus comprising employing as a fuel oil composition in said combustion apparatus a fuel oil composition comprising a middle distillate fuel oil having a sulfur content of 0.2% by weight or less, and a minor proportion of a lubricity additive comprising (a) an ester of an unsaturated monocarboxylic acid and a polyhydric alcohol, and (b) an ester of a polyunsaturated monocarboxylic acid and a polyhydric alcohol having at least three hydroxy groups, the esters (a) and (b) being different.

20. The method of claim 19 wherein the fuel oil is a diesel fuel.

21. The method of claim 20 wherein (a) is a mono-ester of oleic acid and glycerol, and (b) is a mono-ester of linoleic acid and glycerol.

* * * * *